United States Patent [19]

Knopf et al.

[11] 4,298,344

[45] Nov. 3, 1981

[54] AGE RESISTANT CHROME TANNING AGENTS

[75] Inventors: Herbert Knopf; Heinrich Spahrkäs; Wolfhard Luck, all of Leverkusen, Fed. Rep. of Germany

[73] Assignee: Bayer Aktiengesellschaft, Leverkusen, Fed. Rep. of Germany

[21] Appl. No.: 121,863

[22] Filed: Feb. 15, 1980

[30] Foreign Application Priority Data

Mar. 7, 1979 [DE] Fed. Rep. of Germany ..... 2908967

[51] Int. Cl.[3] ..... C14C 3/06

[52] U.S. Cl. ..... 8/94.26; 8/94.27

[58] Field of Search ..... 8/94.27, 94.26

[56] References Cited

U.S. PATENT DOCUMENTS 3,174,817 3/1965 Spahrkas et al. ..... 8/94.26

FOREIGN PATENT DOCUMENTS 1304531 9/1962 France .

*Primary Examiner*—A. Lionel Clingman

*Attorney, Agent, or Firm*—Sprung, Felfe, Horn, Lynch & Kramer

[57] ABSTRACT

A pulverulent spray dried chrome tanning agent having about 1.8 to 2.6 mols of formate/mol $Cr_2O_3$, a basicity of at least about 42% and a sulphate content of at least about 1.8 mols $SO_3$/mol $Cr_2O_3$, maintaining its solubility in water over a prolonged period of time compared with a similar composition having a lower sulphate content, i.e. the latter becomes increasingly water-insoluble with the passage of time.

4 Claims, No Drawings

AGE RESISTANT CHROME TANNING AGENTS

This invention relates to exceptionally age-resistant chrome tanning agents the solubility in water of which is preserved over prolonged periods.

It is known to use pulverulent chrome tanning agents having a formate content of approximately 2 mols/mol of $Cr_2O_3$ and a basicity of approximately 50% for tanning animal skins and hides (see e.g. E. Erdmann, "Das Leder", 16 (1965), page 262). Tanning substances of this type are distinguished by the mild tanning action thereof and the good dye absorption of the leathers obtained. They are readily soluble in water, but lose this property after prolonged storage. This is disadvantageous for practical purposes because chrome tanning agents are generally poured into the tanning vats as powders without being first dissolved. If tanning agents of this type have been stored for some time they are in many cases unable to dissolve completely in the time available for tanning. This may result in a delay of the tannage or the formation of stains due to undissolved residual tanning agent being left on the tanned leather, the market value of the leather being thereby reduced.

It has now been found that pulverulent chrome tanning agents which have a formate content of about 1.8 to 2.6 mols/mol of $Cr_2O_3$ and a basicity of at least about 42%, preferably about 50%, and which have been adjusted to a sulphate content of at least about 1.8 mols $SO_3/Cr_2O_3$ before drying and have subsequently been spray dried, maintain their solubility even after prolonged storage.

The present invention therefore relates to age-resistant spray dried chrome tanning agents having a formate content of from about 1.8 to 2.6 mols/mol $Cr_2O_3$ and a basicity of at least 42%, characterized in that they have a sulphate content of at least 1.8 mols $SO_3$/mol $Cr_2O_3$.

The known pulverulent chrome tanning agents mentioned above which have a formate content of about 2 mols/mol $Cr_2O_3$ and a basicity of about 50%, only have a sulphate content of about 1.6 mols $SO_3$/mol $Cr_2O_3$.

It has surprisingly been found that this increase in the sulphate content before spray drying preserves the solubility of these products even after prolonged storage.

The preparation of the products according to the present invention is carried out by known methods (see e.g. Ullmann, Enz. der Techn. Chemie, 4th Ed. 1975, Vol. 9, p. 614–615). Thus, the known tanning agents which have a formate content of about 2 mols of formate per mole of $Cr_2O_3$ and a sulphate content of about 1.6 mols of $SO_3$ per mol of $Cr_2O_3$ may be adjusted to a sulphate content of at least 1.8 mols $SO_3$/mol $Cr_2O_3$ before spray drying and then spray dried. Alternatively, chrome sulphate tanning substances may be directly prepared having a formate content of from 1.8 to 2.6 mols of formate per mol of $Cr_2O_3$ and a sulphate content of at least 1.8 mols of $SO_3$ per mol of $Cr_2O_3$, e.g. by using formic acid, sodium formate or calcium formate and adjusting the basicity by the conventional methods.

The tanning properties of the tanning agents according to the present invention are no different from those of the known tanning agents which are masked with formate and have a low sulphate content. The tanning agents according to the present invention may therefore be used in the conventional manner. The tanning agents according to the present invention may be used as such or as mixtures with alkalizing agents, such as magnesium oxide, sodium bicarbonate or dolomite, and/or other masking agents, e.g. salts of dicarboxylic acids.

The chrome tanning agents according to the present invention are particularly suitable for a tanning process in which very complete extraction of the chrome liquors is achieved by first pre-tanning the pickled unhaired hides using chromium (III) salts and then retanning using chromium (III) salts and acid binding agents. The total quantity of chromium oxide provided is from about 1.0 to 1.8%, based on the pelt weight and tanning is carried out using a volume of liquor of $\leqq 100\%$ (again based on the pelt weight) and to a final pH of $\geqq 3.6$.

Pulverulent chrome tanning agents which are particularly valuable for leather manufacture and particularly stable as regards solubility in water contain from about 1.8 to 2.4 mols of formate per mol of $Cr_2O$ and from 1.8 to 2.8 mols of $SO_3$/mol of $Cr_2O_3$ and have a basicity of about 48 to 52%.

The present invention will now be illustrated in more detail with the aid of the following examples, in which the percentages given in the compositions are percentages by weight.

EXAMPLE 1

5000 kg of chromium sulphate liquor containing 11% $Cr_2O_3$, 14.4% $SO_3$, 11.2% $Na_2O$ and 6.8% formic acid are dried in a spray drier at 200° C. inlet temperature and 90° C. outlet temperature. The dried product contains 21.5% $Cr_2O_3$, 13.3% formic acid (2.0 mols formic acid/mol $Cr_2O_3$) and 2.5 mols $SO_3$/mol $Cr_2O_3$ and has a basicity of 50%. The undissolved residue amounts to 0% when the liquor is tested immediately and 0.1% after 30 days rapid ageing.

By comparison, in a product containing 30% $Cr_2O_3$, 20% formic acid (2.2 mols formic acid/mol $Cr_2O_3$) and 1.57 mols $SO_3$/mol $Cr_2O_3$ and having a basicity of 50% which has been dried under the same conditions as above, the undissolved residue is found to be 1% on immediate testing and 24% after 30 days' rapid ageing.

Rapid ageing and testing of solubility are carried out as follows: the dried product is stored in a sealed drying cupboard for 30 days at 50° C. To test the solubility, 200 ml of water are added to 20 g of fresh product and 20 g of product aged as described above, and the diluted product is dissolved by shaking for one hour at room temperature. The residue is then determined gravimetrically after filtration through a suction filter.

EXAMPLE 2

2.2 kg of chromium sulphate liquor containing 13% $Cr_2O_3$, 12.6% $SO_3$, 6.4% $Na_2O$ and 8.7% formic acid are dried in a spray drier at an inlet temperature of 190° C. and an outlet temperature of 120° C. The dried product contains 28% $Cr_2O_3$, 18.7% formic acid (2.2 mols formic acid/mol $Cr_2O_3$) and 1.85 mols $SO_3$/mol $Cr_2O_3$ and has a basicity of 50%. The undissolved residue amounts to 0% on immediate testing and 2% after 30 days' rapid ageing.

Rapid ageing and testing of solubility are carried out as described in Example 1.

EXAMPLE 3

2.2 kg of chromium sulphate liquor containing 12% $Cr_2O_3$, 13.3% $SO_3$, 7.2% $Na_2O$ and 7.9% formic acid are dried in a spray drier at an inlet temperature of 190° C. and outlet temperature of 110° C. The dried product contains 26.4% $Cr_2O_3$. 17.4% formic acid, (2.2 mols formic acid/mol $Cr_2O_3$) and 2.1 mols $SO_3$/mol $Cr_2O_3$ and has a basicity of 50%. The undissolved residue amounts to 0% on immediate testing and 0.2% after 30 days' rapid ageing.

Rapid ageing and testing of solubility are carried out as described in Example 1.

EXAMPLE 4

2.2 kg of chromium sulphate liquor containing 11.1% $Cr_2O_3$, 12.2% $SO_3$, 8.2% $Na_2O$ and 7.3% formic acid are dried in a spray drier at 190° C. inlet temperature and 110° C. outlet temperature. The dried product contains 24.4% $Cr_2O_3$, 16% formic acid (2.2 mols formic acid/mol $Cr_2O_3$) and 2.4 mols $SO_3$/mol $Cr_2O_3$ and has a basicity of 50%. The undissolved residue amounts to 0% on immediate testing and 0.3% after 30 days' rapid ageing.

Rapid ageing and testing of solubility were carried out as described in Example 1.

EXAMPLE 5

2.5 kg of chromium sulphate liquor containing 8.1% $Cr_2O_3$, 12.3% $SO_3$, 11.4% $Na_2O$ and 4.4% formic acid are dried in a spray drier at an inlet temperature of 190° C. and outlet temperature of 120° C. The dried product contains 20.5% $Cr_2O_3$, 11.2% formic acid (1.8 mols formic acid/mol $Cr_2O_3$) and 2.9 mols $SO_3$/mol $Cr_2O_3$ and has a basicity of 50%. The undissolved residue amounts to 0% on immediate testing and 0.1% after 30 days' rapid ageing.

Rapid ageing and testing of solubility are carried out as described in Example 1.

EXAMPLE 6

2.5 kg chromium sulphate liquor containing 7.8% $Cr_2O_3$, 11.9% $SO_3$, 11.9% $Na_2O$ and 4.7% formic acid are dried in a spray drier at an inlet temperature of 190° C. and outlet temperature of 120° C. The dried product contains 20% $Cr_2O_3$, 12% formic acid (2.0 mols formic acid/mol $Cr_2O_3$) and 2.9 mols $SO_3$/mol $Cr_2O_3$ and has a basicity of 54%. The undissolved residue amounts to 0% on immediate testing and 0.1% after 30 days' rapid ageing.

Rapid ageing and testing of solubility are carried out as described in Example 1.

It will be appreciated that the instant specification and examples are set forth by way of illustration and not limitation, and that various modifications and changes may be made without departing from the spirit and scope of the present invention.

What we claim is:

1. A pulverulent spray dried chrome tanning agent having about 1.8 to 2.6 mols of formate/mol $Cr_2O_3$, a basicity of at least about 42% and a sulphate content of at least about 1.8 mols $SO_3$/mol $Cr_2O_3$.

2. A chrome tanning agent according to claim 1, having a basicity of about 50%.

3. A chrome tanning agent according to claim 1, having a sulphate content of about 1.8 to 2.8 mols $SO_3$/mol $Cr_2O_3$.

4. A chrome tanning agent according to claim 3, having a basicity of about 50%.

* * * * *